United States Patent [19]

Suey

[11] 4,424,027

[45] Jan. 3, 1984

[54] INSULATING TILE FOR APPLICATION TO WATER COOLED PIPES AND METHOD FOR APPLYING SAME TO PIPES

[76] Inventor: Paul V. Suey, 1043 Blackforest Rd., Pittsburgh, Pa. 15235

[21] Appl. No.: 388,035

[22] Filed: Jun. 14, 1982

[51] Int. Cl.[3] ..... F27D 3/02

[52] U.S. Cl. ..... 432/233; 432/234; 138/149

[58] Field of Search ..... 432/233, 234; 138/147, 138/149, 158; 52/506, 513

[56] References Cited

U.S. PATENT DOCUMENTS

| | | | |
|---|---|---|---|
| 3,486,533 | 12/1969 | Doherty et al. | 432/234 |
| 4,070,151 | 1/1978 | Suey | 52/513 |
| 4,288,219 | 9/1981 | Gana et al. | 432/234 |
| 4,330,266 | 5/1982 | Suey | 52/506 |
| 4,337,034 | 6/1982 | Morgan et al. | 432/234 |
| 4,362,506 | 12/1982 | Campbell, Jr. | 432/234 |

*Primary Examiner*—Henry C. Yuen

*Attorney, Agent, or Firm*—Parmelee, Miller, Welsh & Kratz

[57] ABSTRACT

An insulating tile section, and a process of securing an insulating tile section about a metal pipe about which the tile section is contoured to fit, where the steps comprise forming the refractory insulation about a metal channel section having a bottom, spaced side walls with outwardly extending flanges along the top edges of the side wall. There is likewise provided a novel weld in which the channel embedded in the tile is attached to the pipe by a weld of generally rivet-like contour.

5 Claims, 4 Drawing Figures

INSULATING TILE FOR APPLICATION TO WATER COOLED PIPES AND METHOD FOR APPLYING SAME TO PIPES

BACKGROUND OF THE INVENTION

This invention is for an improvement in sectional tiles used about the water-cooled pipes of metallurgical furnaces, and the like, and for an improvement in the method of attaching them to the pipe, providing a faster and more effective way of securing them to the pipes. The invention is specifically for an improvement in the tile and method disclosed in my earlier U.S. Pat. No. 4,070,151 granted Jan. 24, 1978.

As disclosed in my U.S. Pat. No. 4,070,151, metallurgical reheating furnaces such as those used in heating metal billets, slabs and the like to a high temperature for hot working generally have a supporting frame with parallel skid rails extending through the furnace from a charging door in one wall to an exit door in an opposite wall. Work pieces are charged in succession onto the skid rails and move in progression, usually with the discharge of one work piece at the exit as a new piece to be reheated is shoved onto the skid rails at the entrance. Temperatures in the furnace and travel time through the furnace may be such as to raise heavy metal pieces to a white-heat, or "hot working temperature".

The skid rails and the supporting frame on which the skid rails are mounted comprise water-cooled pipes about which heat-insulating tiles of complementary shape and divided longitudinally are secured to enclose the pipes, but which, in the case of the skid rails which have a rib or rail along the top on which the work pieces rest and slide, are exposed. This is disclosed in my hereinbefore mentioned patent, the contents of which are incorporated herein by reference.

The refractory insulation is cast in the form of half-sections over a core which contours the semicircular inner face of the casting to fit snugly about the pipe on which the sections are to be used, this generally being of a standard size. If the two half-sections have interfitting parts as disclosed in my U.S. Pat. No. 4,330,266 issued May 18, 1982, the contents of which are incorporated herein, they are interlocked and bolted about the pipe. More commonly, each of the two sections has some fastening that is welded to the pipe and is embedded in the refractory, and once in place, it is fixed until the refractory body of the tile has disintegrated to a point where replacement is necessary. The support frame and skid rails are subject to severe mechanical shock due to the loading and movement of heavy metal pieces onto and along the skid rails and elimination of even slight relative motion between the tile sections and the pipe is important to preventing the early disintegration of the tiles from such causes.

In my U.S. Pat. No. 4,070,151 a flanged metal sleeve is embedded in the tile section when the section is cast, the sleeve or sleeves being radial to the curvature of the tile and with only the circular end of the sleeve being exposed on the inner concave surface of the tile, the flanged outer end of the sleeve being embedded in the tile. A radial hole equal approximately to the internal diameter of the sleeve provides access through which a welding electrode may be inserted through the sleeve when the tile section is in place on the pipe, and by manipulaton of the electrode a weld may be formed between the surface of the pipe and the inner sleeve which is then in contact with the surface of the pipe.

While this method of securing the tile sections about the pipe has been satisfactory and well accepted by the trade, it is not adapted for use with a mig-welder in which a non-oxidizing atmosphere is maintained over the weld while the weld metal is at a high temperature or melted state. A mig-welder is faster, more certain, and requires less skill to be successfully used. Such a welder, roughly speaking, has an inverted cap surrounding the welding electrode and when the electrode is in welding relation to the workpiece and the electrode is energized, the interior of the cap is filled with an inert gas, such as $CO_2$ and air is excluded from the space where welding is taking place.

BRIEF DESCRIPTION OF THE INVENTION

According to the present invention, a short length of flanged metal channel has a bottom, and spaced parallel side walls, each of which has an outwardly turned flange along its length. The bottom or connecting wall of the channel has centered therein an opening of smaller diameter than the inside width of the channel. A dowell having a diameter such as to closely fit between the side walls of the channel has a reduced extension at its inner end inserted into the channel, the extension on the dowell being of a length to project beyond the exterior surface of the end wall of the channel and of a diameter to snugly fit in the opening. This extension on the inner end of the dowell passes through the opening in the base of the channel and may then enter a socket for holding the channel in place on the core about which the insulation is cast. It is located in the position where the tile section will ultimately be fitted about the metal pipe. The refractory insulating compound is then cast in a mold around the core in the usual manner to fill the channel and completely envelope all but the outside of the bottom of the channel. Upon removal of the cast tile from the mold, and at a time when the refractory has set or hardened sufficiently, the dowell, which is of a length to project beyond the periphery of the refractory body, is removed, leaving a radial hole, the diameter of the dowell, from the outersurface of the tile to the metal bottom of the channel and concentric with respect to the opening in the bottom of the tile.

When the finished tile section is to be used, it is temporarily clamped to the pipe, usually with a mating section and the welding end of a mig-welder is inserted in the hole with the rim only of the cap touching the metal bottom of the tile around the inner-periphery of the opening and the welding electrode, closely centered in the opening, contacts the pipe, filling the opening to overflowing with molten metal while the cap of the mig-welder is filled with inert gas, resulting in a rivet-like body welded to the pipe and the channel with the overflowing metal spreading over the surface of the inner face of the channel to form a rivet-like head that assures a secure connection of the tile about the pipe, the embedded channel, which extends lengthwise of the pipe, being immovably secured to the pipe to transmit vibration and shocks from the refractory to the pipe without relative motion between the refractory and the pipe such as would accelerate disintegration of the refractory.

DESCRIPTION OF THE DRAWINGS

The invention may be more fully understood by reference to the accompanying drawings disclosing a presently preferred embodiment of the invention and in which.

DETAILED DESCRIPTION

Figure 1:
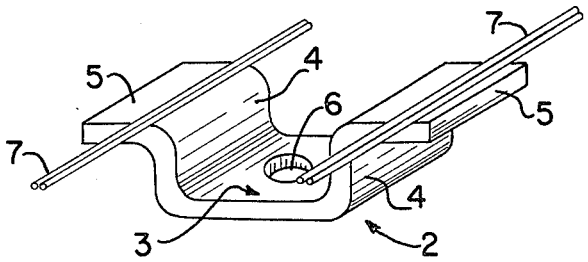
FIG. 1 is a perspective view of a metal, usually steel, channel shaped section to be embedded in the refractory body of a sectional heat insulating tile.

The drawings disclose only a single fastener and method of forming it for which reason it is located about 90° from the edge faces of the tile but there may be a multiple of similar fasteners arranged for example as disclosed in my U.S. Pat. No. 4,070,151.

In the drawings 2 designates a formed metal channel, desirably steel, the channel comprising a base or bottom 3 and parallel side walls 4 along the edges of the base 3 of the section. Each side wall has an outwardly turned flange 5. Centered between the side walls and desirably between the two ends of the channel, the base has a small opening 6 therethrough of a diameter less than the distance between the inner faces of the side walls. Typically, if the distance between the side walls is one inch, the opening 6 is one fourth of an inch in diameter. In this way there is a generally flat area around the opening at each side of the opening from the perimeter of the opening to the nearest side wall of three-eights of an inch. The side walls are then of the order of one-half inch in height and the lateral outward flange on each wall is desirably about one-half inch wide. These dimensions are based on use of the tile around a water-cooled pipe of the diameter commonly found in work supports of the kind herein referred to.

Longitudinally extending stress distributing metal rods 7 of a length appreciably longer than the channel section 2 are welded in pairs, to the flange 5 of the channel. They are welded to the top surface of the flanges and project at each end wall beyond the ends of the channel section. For example these rods might project beyond the ends of the channel about one-inch and each rod may desirably be of the order of one eighth of an inch in diameter. It is to be understood however that dimensions as herein given are believed to be well suited for a tile of a size commonly used, but they may vary as conditions and pipe sizes vary.

Figure 2:
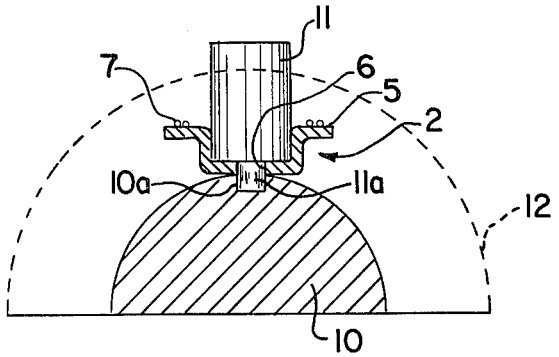
FIG. 2 is a schematic transverse section through a pattern or core about which the plastic insulating compound forming the bottom of the tile will be molded, the view showing the channel of FIG. 1 set lengthwise of the core with a radial dowell having an extension at its inner end passing through the opening in the base of the channel member and entered in the core.

FIG. 2 of the drawing illustrates a first step in the process of making the tile. There is provided a core or pattern 10, here shown as being of semicircular form, the exterior surface of which corresponds to the curvature of the pipe about which the tile is to be fitted. The channel 2 is placed on the core, lengthwise of the core. A dowell 11 of a diameter to fit snugly between the walls of the channel and which has an extension 11*a* at its lower end is inserted into the channel with the extension 11*a* passing through the opening 6 in the base of the channel and it enters a recess or socket 10*a* in the core to position the channel on the core. The ceramic tile forming insulation compound is cast about this assembly in the usual manner, the contour of the outer surface of the casting to be made being indicated by the broken line 12 in FIG. 2. In this process the channel section is filled with and completely surrounded by the insulation so that it is immovably embedded in the refractory body, only the exterior of the bottom 3 of the channel being exposed at the inner curved face of the tile.

Figure 3:
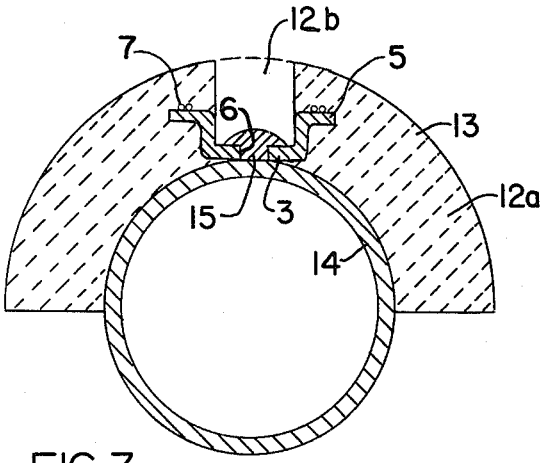
FIG. 3 is a transverse section similar to FIG. 2 but shows a section through the finished tile set on a water-cooled pipe with the channel insert welded to the surface of the pipe.

FIG. 3 is a more or less schematic view in transverse section showing a tile 13 secured to the pipe after the refractory 12*a* has set and the tile is ready for use. In the first place, when the refractory body sets about the channel, the dowell 11, which is of a length to project beyond the outer surface of the refractory is removed, releasing the cast body from the core and leaving in the tile a radial hole 12*b* from the exterior of the tile to the inner face of the bottom 3 of the metal channel. The hole 12*b*, of larger diameter, is centered around the small opening 6 through the base of the channel, this hole being also clean and clear of the refractory.

Thus, when the section of tile, with its heat insulating body 13 having its inner face concentric with the exterior of the water-cooled pipe 14, is set on the pipe, as shown in FIG. 3, a welding electrode, preferably the end of a mig-welder, is inserted in the hole 12*b* and the electrode, being centered in the tool, passes through the opening 6 where it contacts the metal of the pipe. The opening in the bottom is quickly filled to overflowing level, the metal then spreading out over the flat inner surface of the bottom of the channel, forming a rivet-like head overlapping the exposed inner surface of the channel, and weld is then completed.

When a mig-welder is used, having its welding terminal inserted in the radial hole in the ceramic tile, the inert gas cap will pass through the hole and seat against the inside of the bottom of the channel and the welding electrode will be centered more or less exactly in the small opening through the bottom of the channel. The gas cap fills with inert gas, usually $CO_2$, and when the electrode contacts the pipe against which the tile is fitted, the electrode will melt, first filling the opening in the channel to excess, overflowing over the inner surface of the channel around the edges of the opening. As the molten metal quickly solidifies a rivet-like appearing fastening 15 is formed, in situ. Mig-welders are well-known, and the present invention, in addition to providing an improved tile, enables the use of this type of welder for rapid and effective attachment of the tile to the pipe.

After the tile has been attached to the tube in this manner the radial hole 12*b* may be filled with heat-insulating cement, similar or the same as that of which the tile itself is formed, or other heat resistant refractory compound may be used. The relatively large area of the channel in contact with the metal pipe, and the refractory tile, along with the stress distributing rods 7, in addition to the outwardly turned flanges of the channel, effectively integrate the refractory and the metal so as to eliminate relative looseness between the pipe and the tile and effectively distribute vibration and shock waves to reduce their destructive effect. The overflowing hot metal that spreads over the inner surface of the channel forming an integral rivet-like weld, between the pipe 14 and the channel in the title, is indicated at 15 in FIG. 3.

Figure 4:
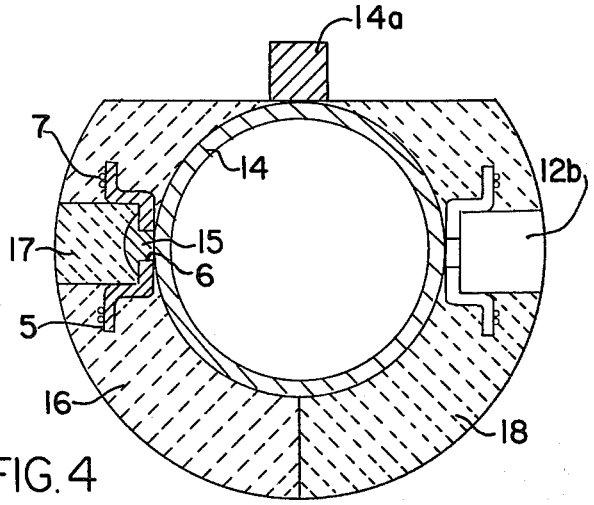
FIG. 4 is a transverse view showing the manner in which two complementary tile sections are fitted about a skid-rail pipe section, the tile at the left of the figure being welded to the pipe and the radial hole filled with refractory cement, while the section on the right is yet to be welded.

In FIG. 4, there is illustrated the application of the tile to a pipe 14, which in this illustration is a skid rail in which the work support 14*a* along the top of the support pipe is not enclosed in the refractory tile. At the left of the figure, the tile section 16 has been secured to the pipe, as shown by the rivet-like weld at 15 and the radial hole, left by removal of the dowell, has been filled with refractory 17 which bonds to the body of the tile and protects the weld, which is water-cooled by contact with the pipe from exposure to the furnace atmosphere.

The tile section 18 at the right is in position to be welded, the radial hole 12*b* being open for the insertion of the welding tool. The relatively small mass of metal in the weld cools quickly and is completed in an atmosphere of inert gas to avoid oxidation and there is not such a "pool" of metal at anytime as to flow out the hole under the influence of gravity during the welding operation, even in a position as shown in FIG. 4. Mig-welders are well-known and in addition to providing an improved tile and method of securing it to the pipe the present invention makes available use of this oxidation-free type of welder for effective and rapid installation of heat insulating tile section about the pipes of a work support or like structure where water-cooled pipes are exposed to a high temperature environment.

What is claimed is:

1. In a refractory tile section for application lengthwise about a water-cooled steel pipe such as pipes used for support of work pieces in a metallurgical reheating furnace and the like, the tile comprising an elongate body of concavo-convex transverse cross-section, the inner concave surface of which conforms to the exterior curvature of the metal pipe to which the tile is to be applied for use with at least one other complementary tile section of matching contour, the improvement wherein;

(a) the refractory body of the tile has a flanged channel section embedded therein which has a bottom, an upstanding side wall along each side of the bottom, each side wall having a laterally turned flange along its upper edge, the bottom having at least one opening therethrough substantially centered between the two side walls of the channel and of a diameter not substantially greater than half the distance between the side walls of the channel, the tile having a radial hole, extending through the refractory from the bottom of the interior of the channel to the exterior of the refractory, of a diameter approximately equal to the distance between the side walls of the channel, and concentric with the opening through the bottom of the channel, the outer surface of the bottom of the channel being clear of the surrounding refractory body of the tile whereby said surface may contact the exterior of the metal pipe about which the tile is placed, the metal of the channel being otherwise embedded in and surrounded by the refractory including the interior of the channel except where said radial hole is located.

2. The tile section defined in claim 1 wherein the tile is secured to the surface of the water-cooled pipe against which it is positioned by a rivet-like weld in which welding metal fused to the surface of the pipe and filling the opening in the bottom of the channel extends over the exposed inner face of the channel whereby there is a rivet shaped weld through the opening in the channel with an integral head portion welded to the inner face of the channel in the open area of the channel surrounding the opening.

3. The tile section defined in claim 1 or 2 wherein stress distributing rods of a length longer than the length of the channel are welded to the top surfaces of the flanges of the channel and project lengthwise of the tile beyond both ends of the channel into the body of the refractory.

4. The tile section defined in claim 1 in which the opening through the bottom of the channel is centered between the ends of the channel as well as between the sides.

5. The tile section defined in claim 1 in which the radial hole in the refractory body of the tile is large enough to receive the inert gas enclosure at the welding terminal of a mig-welder.

* * * * *